US005556252A

United States Patent [19]

Kuster

[11] Patent Number: 5,556,252

[45] Date of Patent: Sep. 17, 1996

[54] STACK LIFTING APPARATUS AND METHOD

[75] Inventor: Richard Kuster, Darmstadt, Germany

[73] Assignee: MAN Roland Druckmaschinen AG, Germany

[21] Appl. No.: 410,706

[22] Filed: Mar. 27, 1995

[30] Foreign Application Priority Data

Mar. 25, 1994 [DE] Germany ..... 44 10 384.0

[51] Int. Cl.[6] ..... B65G 59/02

[52] U.S. Cl. ..... 414/796.7; 271/155; 414/786; 414/926

[58] Field of Search ..... 271/155, 152; 414/796.7, 926, 786

[56] References Cited

U.S. PATENT DOCUMENTS

| | | | |
|---|---|---|---|
| 4,021,710 | 5/1977 | Fichte et al. | 414/796.7 X |
| 4,832,329 | 5/1989 | Rodi et al. | 271/155 |
| 4,919,410 | 4/1990 | Robinson, Jr. et al. | 271/155 X |
| 5,295,678 | 3/1994 | Lindner et al. | 271/152 |
| 5,397,118 | 3/1995 | Iida et al. | 271/155 |

FOREIGN PATENT DOCUMENTS

| | | |
|---|---|---|
| 3631456C2 | 8/1989 | Germany . |
| 4135752C1 | 11/1992 | Germany . |

*Primary Examiner*—Karen B. Merritt
*Assistant Examiner*—Janice L. Krizek
*Attorney, Agent, or Firm*—Leydig, Voit & Mayer, Ltd.

[57] ABSTRACT

A method and apparatus for feeding sheets from a top of a sheet stack supported on a stack lifting table to a sheet processing machine. The stack lifting table supporting the sheet stack is raised by a motor until the top of the sheet stack has reached a predetermined maximum level. At this position, the sheets are fed by a feeding mechanism from the sheet stack to the sheet processing machine to lessen the stack height until the top of the sheet stack has reached a predetermined minimum level as determined by a sensor. The rate at which the stack height is lessened as sheets are fed from the stack lifting table is then determined by a controller from the known distance between the predetermined maximum and minimum levels and a value corresponding to the speed at which sheets are fed from the stack. The speed value, or sheet cycle time, may be received from the processing machine, or may be a time duration measured by a timer. The motor is then controllably operated to raise the stack lifting table at a rate corresponding to the rate at which the stack height is lessened, thereby maintaining the top of the stack at substantially the same height as sheets are fed to the sheet processing machine.

19 Claims, 3 Drawing Sheets

STACK LIFTING APPARATUS AND METHOD

TECHNICAL FIELD OF THE INVENTION

The present invention relates generally to sheet processing machines such as a printing press, and more particularly to a stack lifting apparatus and method for feeding sheets from a stack of sheets to a sheet processing machine.

BACKGROUND OF THE INVENTION

Sheet processing machines, such as printing presses, require a continuous input of sheets at a constant rate. Typically, the sheets are provided to such sheet processing machines in the form of a sheet stack, whereby sheets are fed into the sheet processing machine from the top of the sheet stack via a feeding mechanism. In order for these feeding mechanisms to reliably engage the sheets, it is a necessary requirement that the uppermost sheet in the stack be maintained within a relatively narrow height range.

To keep the uppermost sheet within the required range, the sheets are typically stacked upon a stack lifting table which can be raised as needed to compensate for the reduction in the stack height as sheets are removed. Ordinarily, a motorized stack lift drive is provided for raising the stack lifting table and the stack of sheets thereon so that the top surface of the uppermost sheet is within the proper height range. Since the speed that sheets are fed to the sheet processing machine depends on the operating speed of the printing press, and since the height of the top of the stack varies in dependence on the sheet thickness as sheets are removed, the drive must raise the stack lifting table in dependence on these parameters.

One method of keeping the top of the stack within the appropriate range of heights utilizes an operator to manually adjust the rate at which the stack lifting table rises. With this method, an initial lifting speed is estimated from the sheet thickness and the operating speed of the sheet processing machine. The estimated lifting speed is then typically corrected by the operator based on observation and experience. This method is not very desirable, inasmuch as it requires operator attention to the sheet processing machine. The problem is particularly troublesome when sheet stacks having unknown sheet thicknesses are to be fed to the sheet processing machine, in which case the sheet thickness must be recalculated.

Other methods of operating lift motors to maintain the required stack height are described in U.S. Pat. No. 5,295,678, assigned to the assignee of the present invention and hereby incorporated by reference in its entirety. In the method and system of U.S. Pat. No. 5,295,678, the lift motor operates in either a continuous or discontinuous manner depending on the sheet thickness input into the system. While this system is generally reliable, it selects the operating mode of the motor according to the sheet thickness and processing speed. Proper motor operation thus depends on the proper sheet thickness being input into the system by an operator, a task which must be carefully repeated each time the type of sheet is varied. Moreover, if a sheet selected for measurement is particularly thick or thin with respect to average sheet thicknesses, the motor operating speed will be incorrect.

OBJECTS AND SUMMARY OF THE INVENTION

Accordingly, it is an object of the present invention to provide a simple control method and apparatus for a motorized stack lifting mechanism in which the lifting speed of the stack lifting table may be automatically adjusted.

It is yet another object of the present invention to provide a stack lifting method and apparatus of the above kind that operates reliably and automatically regardless of the printing speed and/or the printing sheet thickness.

It is a related object to provide a method and apparatus as characterized above that eliminates the need to precisely input the sheet thickness.

It is another object to provide such a method and apparatus that inherently compensates for surface roughness of the Sheets and other factors that may influence the thickness of a particular sheet.

Briefly, the present invention provides a method and apparatus for feeding sheets from a top of a sheet stack supported on a stack lifting table to a sheet processing machine. The stack lifting table supporting the sheet stack is raised by a motor until the top of the sheet stack has reached a predetermined maximum level. At this position, the sheets are fed by a feeding mechanism from the sheet stack to the sheet processing machine to lessen the stack height until the top of the sheet stack has reached a predetermined minimum level as determined by a sensor. The rate at which the stack height is lessened as sheets are removed from the stack lifting table is then determined by a controller from the known distance between the predetermined maximum and minimum levels and a value corresponding to the speed at which sheets are removed from the stack. The speed value, or sheet cycle time, may be received from the processing machine, or may be a time duration measured by a timer. The motor is then controllably operated to raise the stack lifting table at a rate corresponding to the rate at which the stack height is lessened, thereby maintaining the top of the stack at substantially the same height as sheets are removed to the sheet processing machine.

Other objects and advantages will become apparent from the following detailed description when taken in conjunction with the drawings, in which:

DETAILED DESCRIPTION OF THE PREFERRED EMBODIMENT

Figure 1:
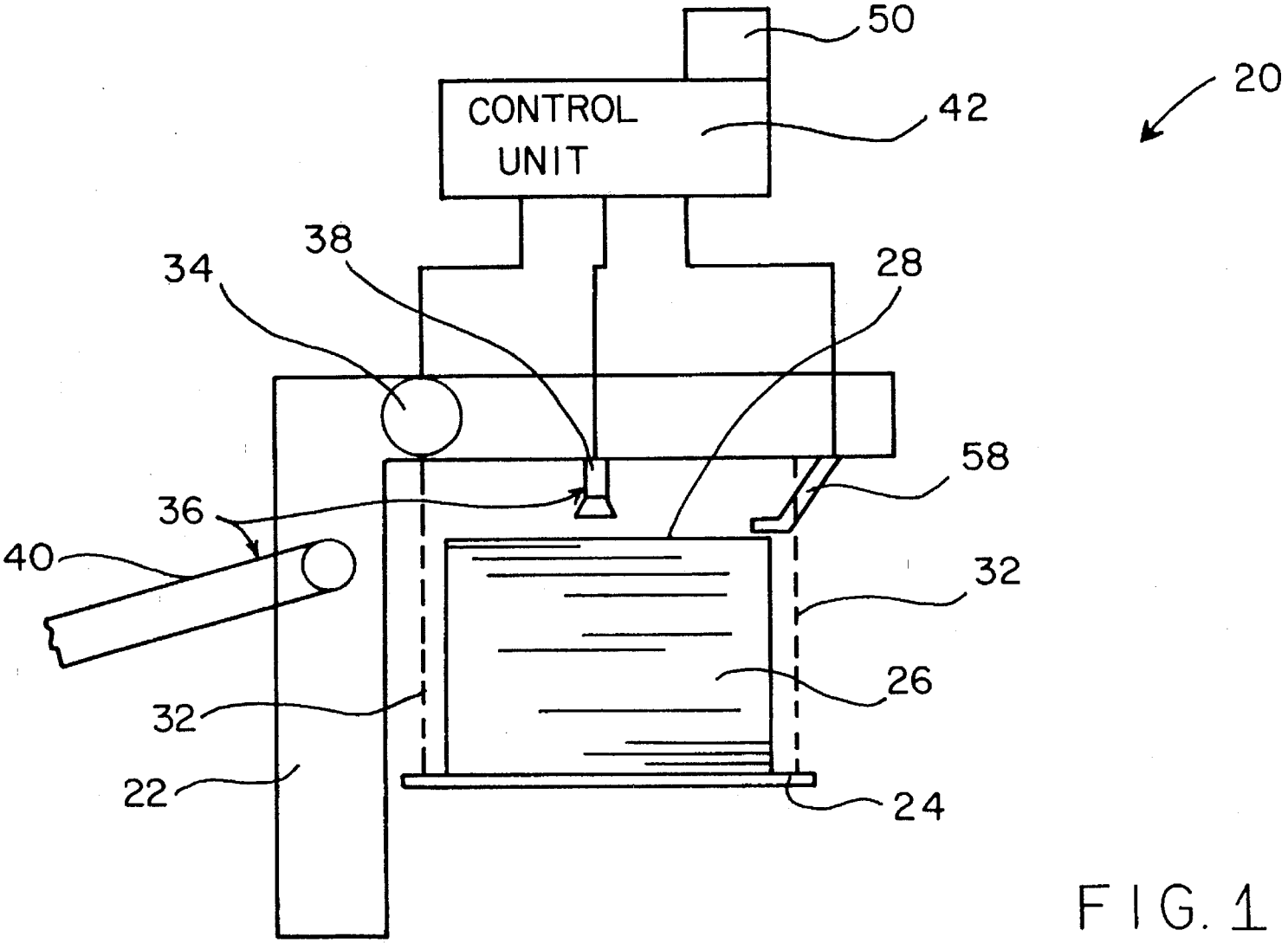
FIG. 1 is a representation of a stack lifting apparatus in accordance with the present invention.
Figure 2:
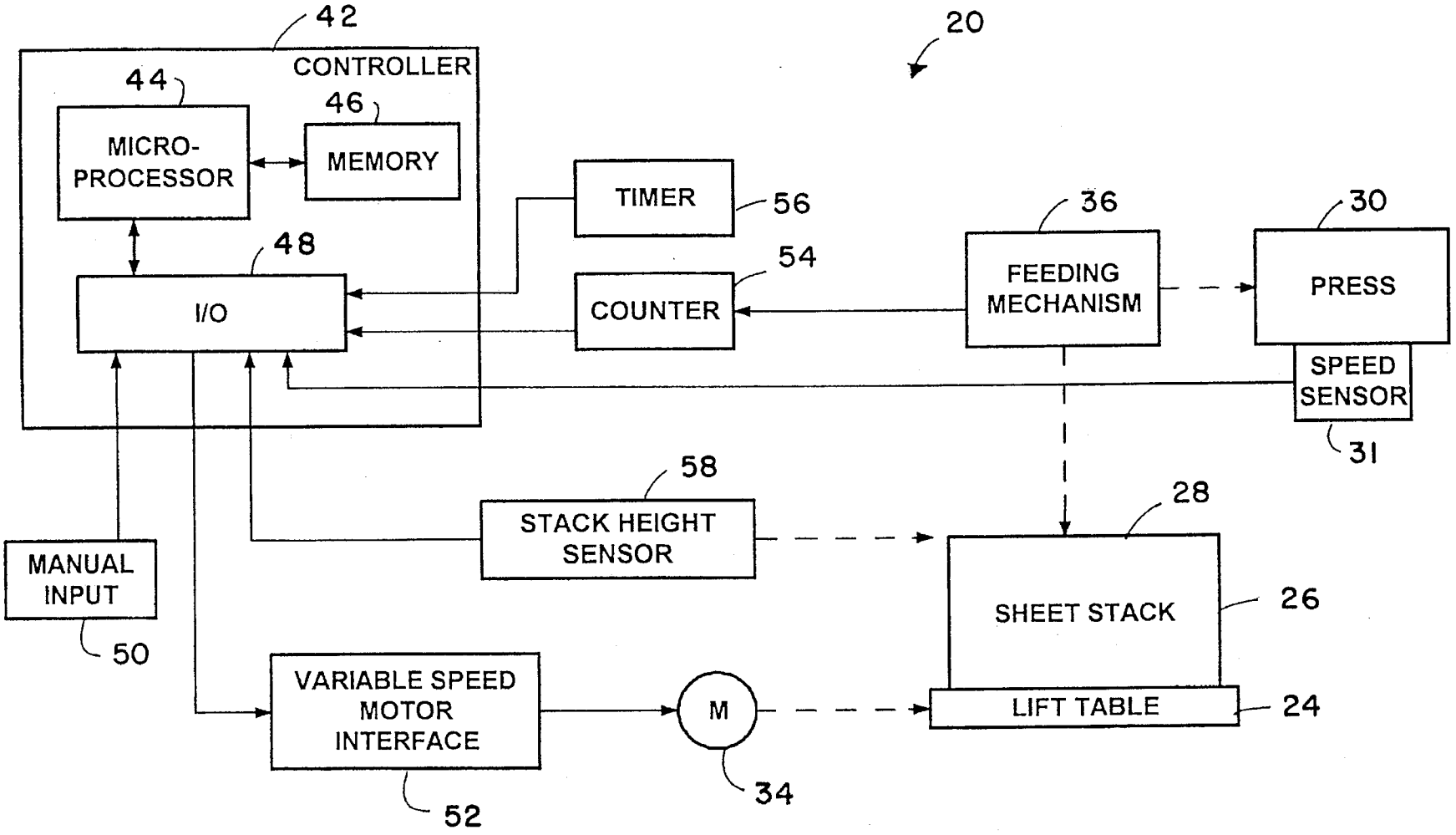
FIG. 2 is block diagram illustrating a control system for operating the stack lifting apparatus of FIG. 1.

Turning first to FIGS. 1 and 2 of the drawings, there is shown a stack lifting apparatus generally designated 20 including a frame 22 supporting a stack lifting table 24 having a sheet stack 26 including an uppermost sheet 28 thereon. The sheets of the stack 26 are individually fed to a sheet processing machine 30, which is preferably a printing press, and the sheets preferably are paper sheets. The sheet processing machine 30 may have a speed sensor 31 associated therewith from which the speed of processing the sheets can be determined.

The stack lifting table 24 is suspended on chains 32, which allow the stack lifting table 24 to be raised or lowered by a motorized raising means. The raising means preferably comprises an electric motor 34 coupled to chain wheels or a similar transmission mechanism (not shown). Preferably, the electric motor 34 is a direct current motor or a frequency-controlled, three-phase alternating current motor. In operation, so that a continuous supply of sheets may be made available to the sheet processing machine 30, the stack lifting table 24 is raised by the motor 34 to keep the uppermost sheet 28 in the sheet stack 26 accessible to a feeding mechanism 36.

To feed sheets to the sheet processing machine 30, the uppermost sheet 28 is fed from the sheet stack 26 to the sheet processing machine 30 via the feeding mechanism 36. The feeding mechanism 36 comprises a sheet-separating device 38, which may be a suction-based device, operating in conjunction with a strap-type table 40. The feeding mechanism 36 functions such that the uppermost sheet 28 is separated from the sheet stack surface 26 by the sheet-separating device 38 and fed to the strap-type table 40, which in turn conveys the sheets to the sheet processing machine 30.

In accordance with one aspect of the invention, the operation of the stack lifting apparatus is controlled by a controller 42 at a lifting speed that maintains the top of the stack at a substantially constant level as sheets are fed to the printing machine. As shown in FIG. 2, the preferred controller 42 includes a microprocessor 44, a memory 46, and input/output (I/O) means 48 for receiving information signals and outputting control signals. The memory 46 has stored therein the distance from a predetermined maximum level and a predetermined minimum level for the uppermost sheet in the sheet stack 26, i.e., the size of the range of stack heights wherein the sheet-separating device 38 can reliably engage the sheets. Since this distance does not usually change, there is no need to re-enter it each time the press is run. However, since it is foreseeable that this range distance may occasionally vary, the apparatus 20 may be arranged to input this value. For inputting information such as the range distance, the controller 42 may include a manual input means 50.

In keeping with the invention, the controller 42 is connected through an appropriate variable speed interface 52 to drive the lift motor 34. In this manner, an appropriate signal from the controller 42 determines the lifting speed of the motor 34. For example, the variable speed interface 52 may include a digital-to-analog voltage converter with its output connected to an appropriate driver such that digital signals from the processor 44 are converted to an appropriate voltage and current levels to controllably operate a DC motor 34. Alternatively, the interface may provide a frequency to control the motor speed.

To determine the operating parameters necessary to determine the desired lifting speed, the controller 42 is further connected to a counter 54, which counts the number of sheets fed by the feeding mechanism 36. For example, the counter may provide counting pulses corresponding to the sheet count to the controller 42, which then increments a pulse count internally. The controller 42 may be further connected to a timer 56. If desired, the timer 56 may be internal to the controller 42.

To obtain the rate at which sheets are removed, the level, or height, of the sheet stack 26 as determined by the uppermost sheet 28 thereof is sensed via a sensing device 58 connected to the controller 42. The sensing device 58 may be a pivotable arm which provides electrical signals indicative of the vertical position of the uppermost sheet 28 in the stack of sheets 26. Alternatively, an optical sensing device or an electrical sensing device such as one employing microswitches may be utilized. Regardless of the actual sensing device employed, distinct signals are provided at least at a predetermined maximum height and a predetermined minimum height to indicate to the controller 42 when the uppermost sheet 28 in the stack of sheets 26 has risen to the predetermined maximum level or has fallen to the predetermined minimum level, respectively.

Figure 3:
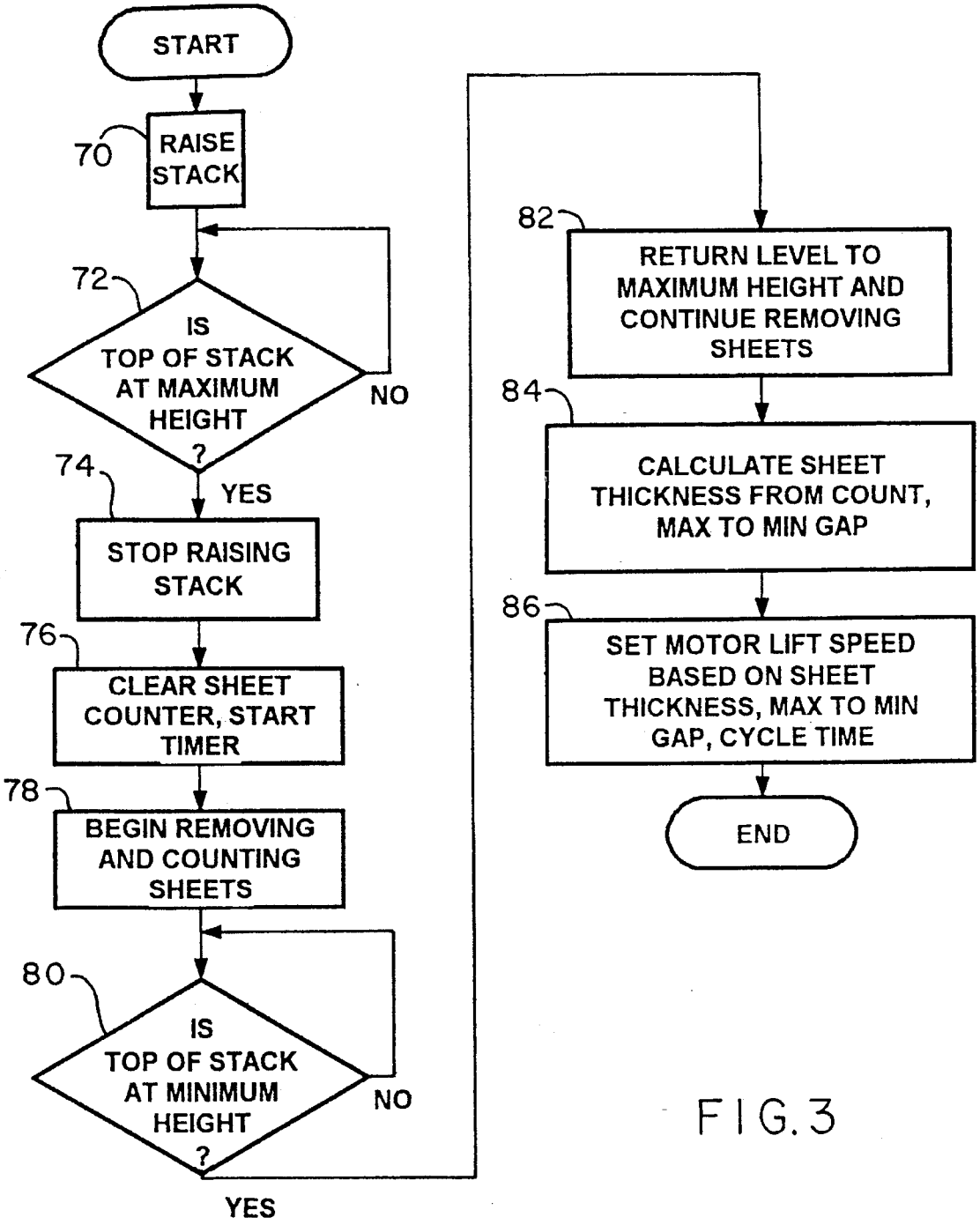
FIG. 3 is flow diagram representing the general steps for determining the desired lifting speed.

Turning to an explanation of the operation of the invention with particular reference to the flow diagram of FIG. 3, when a sheet stack is first placed on the stack lifting table 24, at steps 70–74 the sheet stack 26 is raised until the uppermost sheet 28 reaches the predetermined maximum level as indicated by the stack height sensor 58. Once the maximum level has been reached, at step 76 the controller effectively clears the sheet counter 54, and, if utilizing a timer, also effectively clears the timer 56. At this time, the uppermost sheet 28 in the sheet stack 26 is at the predetermined maximum height, wherein the sheet separator 38 can reliably engage the sheet. At step 78 the feeding mechanism 36 begins removing sheets from the stack, while concurrently, the counter 54 begins counting the number of sheets removed.

The removal of sheets continues until at step 80 the stack height sensor 58 reports to the controller 42 that the uppermost sheet 28 in the stack 26 is at the predetermined minimum level. At this time, the uppermost sheet 28 in the sheet stack 26 is returned to the maximum level at step 82, while sheets are removed from the stack. Preferably the uppermost sheet 28 in the stack 26 is returned quickly to the predetermined maximum level.

To determine the sheet thickness, and consequently determine the optimal lifting speed, at step 84 the sheet thickness is calculated by the controller 42 from the distance, or the size of the range between the maximum and minimum levels stored in the memory 46, divided by the number of sheets fed to the processor as established by the counter 54. The value thus obtained will be an average sheet thickness that accounts for surface roughness of the sheets and other factors, and will not require operator correction.

In one embodiment, the sheet processing speed, i.e., the sheet cycle time is known to the controller 42 from the speed sensor 31 connected to the press 30 or by being input manually at manual input means 50. It can be readily appreciated that in this embodiment, the timer 56 is not necessary to determine the sheet cycle time.

In accordance with the invention, at step 86, the optimal lifting speed, which is the speed that the motor 34 is operable at to keep the uppermost sheet 28 in the stack 26 at substantially the same height to compensate for sheets being removed from the stack 26, is calculated from the calculated sheet thickness times the cycle time per sheet.

In an alternate embodiment including the timer 56, the sheet processing speed, i.e., the sheet cycle time, may be calculated from the number of sheets counted by counter 54 divided by the time indicated by the timer 56. It can also be appreciated that if the timer 56 is utilized, then the optimal lifting speed according to the invention can be directly determined by the known range distance stored in the memory 46 divided by the time taken to lower the top of the stack from the maximum to minimum levels.

Regardless of how the optimal speed is calculated, the calculated speed can be converted to a motor speed in RPMs in a known manner. In accordance with the invention, operating the motor at this speed maintains the sheet that is the uppermost sheet 28 in the stack surface 26 at a constant level at (or near) the predetermined maximum level as sheets are fed into the sheet processing machine 30. Driving the motor 34 at this constant speed allows the motor 34 to be operated continuously, rather than intermittently, which reduces the load on the motor 34. This provides a benefit by prolonging the operating life of the motor and reducing the amount of maintenance necessary.

The controller 42 may be designed to accommodate disruptions in the supply of paper to the sheet processing machine. For example, if the uppermost sheet 28 falls sufficiently below the predetermined maximum level, such as during a non-stop stack changeover, then the controller 42 may cause the stack lifting table 24 to rise at a relatively rapid rate until the stack again reaches the predetermined maximum height. The continuous lifting of the stack table 24 at the calculated lifting speed then will be resumed when the sensing device 58 generates an upper level signal at this maximum height.

Alternatively, the controller 42 may cause the stack lifting table 24 to raise to a different height level, which may be input by an operator via an input unit 50 to the controller 42 and stored in the memory 46 thereof. This predetermined distance, for example, may correspond to the thickness of the spikes of an auxiliary stack table.

As can be seen from the foregoing detailed description, there is provided a simple control method and apparatus for a motorized stack lifting mechanism in which the lifting speed of the stack lifting table may be automatically adjusted. The apparatus and method operates reliably and automatically regardless of the printing speed and/or the printing sheet thickness, while eliminating the need to precisely input the sheet thickness. Thus, sheet stacks of unknown sheet thicknesses may be fed to the sheet processing machine without requiring operator adjustment of the desired lifting speed. Moreover, because the motor is run at a continuous lifting speed for long periods of time, the method and apparatus of the invention result in a longer running time and longer maintenance interval for the motor.

While particular embodiments of the invention have been shown, it will of course be understood that the invention is not limited thereto since modifications may be made by those skilled in the art, particularly in light of the foregoing teachings. It is, therefore, contemplated by the appended claims to cover any such modifications as incorporate those features which constitute the essential features of these improvements within the true spirit and scope of the invention.

What is claimed is:

1. A method for feeding sheets from a top of a sheet stack supported on a stack lifting table to a sheet processing machine, the method comprising the steps of, raising the stack lifting table supporting the sheet stack until the top of the sheet stack has reached a predetermined maximum level, feeding the sheets from the top of the sheet stack to the sheet processing machine to lessen the stack height until the top of the sheet stack has reached a predetermined minimum level, determining a rate at which the stack height is lessened as sheets are fed from the stack lifting table by utilizing the distance between the predetermined maximum and minimum levels and a value corresponding to the speed at which sheets are fed from the stack, raising the stack lifting table at a rate greater than the rate at which the feeding of the sheets lessens the stack height to raise the top of the stack above the minimum level as sheets are fed to the sheet processing machine, and raising the stack lifting table at a rate corresponding to the rate at which the feeding of the sheets lessens the stack height to maintain the top of the stack at substantially a constant height as sheets are fed to the sheet processing machine.

2. A method according to claim 1, wherein the step of determining a rate at which the stack height is lessened includes the step of determining the sheet thickness by counting the sheets fed from the stack between the predetermined maximum and minimum levels, and dividing by the distance therebetween.

3. A method according to claim 1, wherein the step of determining a rate at which the stack height is lessened includes the step of receiving from the sheet processing machine the value corresponding to the speed at which sheets are fed from the stack.

4. A method according to claim 1, wherein the step of determining a rate at which the stack height is lessened includes the steps of operating a timer to determine the time taken to lessen the stack height from the predetermined maximum to the predetermined minimum levels, whereby the value corresponding to the speed at which sheets are fed from the stack is a time value, and dividing the distance between the predetermined maximum and minimum levels by the time.

5. A method according to claim 1, wherein the step of raising the stack lifting table supporting the sheet stack until the top of the sheet stack has reached a predetermined maximum level comprises the step of sensing the height of the top of the sheet stack.

6. A method according to claim 1 further comprising the steps of, sensing the height of the top of the sheet stack, evaluating the height to determine if the top of the sheet stack has decreased below a desired level for feeding sheets to the sheet processing machine, and if the top of the sheet stack is below the desired level, raising the sheet stack table at a rate greater than the rate at which the feeding of the sheets lessens the stack height until the top of the stack has reached a predetermined level at or above the desired level.

7. A method according to claim 6 wherein the desired level corresponds to the predetermined maximum level.

8. A method according to claim 6, wherein the desired level is set by an operator.

9. A method according to claim 6 wherein the desired level corresponds to the predetermined minimum level.

10. A stack lifting apparatus for a sheet processing machine, the stack lifting apparatus comprising, a stack lifting table for supporting a sheet stack, the sheet stack comprising a plurality of sheets, a feeding mechanism for feeding the sheets from the sheet stack into the sheet processing machine, a raising means for raising the stack lifting table and the sheet stack supported thereon, a sensor for determining the height of the sheet stack at least at maximum height level and a minimum height level and providing maximum and minimum signals corresponding thereto, means for determining the speed at which sheets are fed from the stack and providing a value corresponding thereto, and a controller, the controller including a memory for storing the distance between the predetermined maximum and minimum levels, a processor, the processor connected to the memory, to the sensor to receive the maximum and minimum signals therefrom, to the means for determining the speed at which sheets are fed, and to the raising means, the processor including a means for determining a rate at which the stack height is lessened as sheets are fed from the stack lifting table, said means operable by recalling from memory the distance between the predetermined maximum and minimum levels and combining it with the value corresponding to the speed at which sheets are fed from the stack, and a means for controlling the speed of the raising means to initially raise the stack lifting table at a rate greater than the rate at which the stack height is lessened thereby raising the top of the stack to a desired level above the minimum level as sheets are fed to the sheet processing machine, and to subsequently raise the stack lifting table at a rate corresponding to the rate at which feeding of the sheets lessens the stack height, thereby maintaining the top of the stack at substantially the desired level as sheets are fed to the sheet processing machine.

11. A stack lifting apparatus according to claim 10, wherein the raising means comprises an electric motor.

12. A stack lifting apparatus according to claim 11, wherein the motor is a direct current motor.

13. A stack lifting apparatus according to claim 11, wherein the motor is a frequency-controlled, three-phase alternating current motor.

14. A stack lifting apparatus according to claim 10, wherein the sheet processing machine is a printing machine.

15. A stack lifting apparatus according to claim 10, wherein the means for determining the speed at which sheets are fed from the stack comprises a speed sensor connected to the sheet processing machine.

16. A stack lifting apparatus according to claim 10, wherein the means for determining the speed at which sheets are fed from the stack comprises a timer providing a time duration corresponding to the speed.

17. A stack lifting apparatus according to claim 10, wherein the means for determining a rate at which the stack height is lessened as sheets are fed from the stack lifting table comprises a means for determining a sheet thickness.

18. A stack lifting apparatus according to claim 17, wherein the means for determining the sheet thickness includes a counter.

19. A method for feeding sheets from a top of a sheet stack supported on a stack lifting table to a sheet processing machine, the method comprising the steps of, raising the stack lifting table supporting the sheet stack until the top of the sheet stack has reached a predetermined maximum level, feeding the sheets from the top of the sheet stack to the sheet processing machine to lessen the stack height until the top of the sheet stack has reached a predetermined minimum level, determining a rate at which the stack height is lessened as sheets are fed from the stack lifting table by utilizing the distance between the predetermined maximum and minimum levels and a value corresponding to the speed at which sheets are fed from the stack, and continuously raising the stack lifting table at a rate corresponding to the rate at which the feeding of the sheets lessens the stack height to maintain the top of the stack at substantially a constant height as sheets are fed to the sheet processing machine.

* * * * *